US009719751B2

(12) United States Patent
Berger

(10) Patent No.: US 9,719,751 B2
(45) Date of Patent: Aug. 1, 2017

(54) PROJECTILE DELIVERY SYSTEM WITH VARIABLE VELOCITY CONTROL

(71) Applicant: Rory Berger, Woodinville, WA (US)

(72) Inventor: Rory Berger, Woodinville, WA (US)

( * ) Notice: Subject to any disclaimer, the term of this patent is extended or adjusted under 35 U.S.C. 154(b) by 0 days.

(21) Appl. No.: 14/904,346

(22) PCT Filed: Jul. 9, 2014

(86) PCT No.: PCT/US2014/046056
§ 371 (c)(1),
(2) Date: Jan. 11, 2016

(87) PCT Pub. No.: WO2015/057281
PCT Pub. Date: Apr. 23, 2015

(65) Prior Publication Data

US 2016/0169615 A1 Jun. 16, 2016

Related U.S. Application Data

(60) Provisional application No. 61/844,078, filed on Jul. 9, 2013.

(51) Int. Cl.
*F41B 11/723* (2013.01)
*F41B 11/60* (2013.01)
(Continued)

(52) U.S. Cl.
CPC ..... *F41B 11/723* (2013.01); *F41B 11/54* (2013.01); *F41B 11/60* (2013.01); *F41B 11/62* (2013.01); *F41B 11/724* (2013.01)

(58) Field of Classification Search
CPC ..... F41B 11/62; F41B 11/00; F41B 11/55; F41B 11/54; F41B 11/60; F41B 11/68;
(Continued)

(56) References Cited

U.S. PATENT DOCUMENTS 5,592,931 A * 1/1997 Johnson ..... F41B 11/54 124/48
5,596,978 A * 1/1997 Johnson ..... F41B 11/54 124/48
(Continued)

FOREIGN PATENT DOCUMENTS

CA 2917930 A1 * 4/2015 ..... F41B 11/60
EP 3019811 A2 * 5/2016 ..... F41B 11/60
(Continued)

*Primary Examiner* — Benjamin P Lee
(74) *Attorney, Agent, or Firm* — Dean A Craine

(57) ABSTRACT

A variable velocity pneumatic launcher including at least one chamber filled with a projectile. The launcher includes a ballast chamber filled with pressurized air released to propel a projectile from the launcher's barrel. The launcher includes a firing chamber filled with ambient air and a ballast chamber filled with pressurized air. A piston rod extends between the chambers and attaches to a firing piston and a ballast piston inside the firing chamber and ballast chamber, respectively. The rod is connected to a velocity valve which controls the rod's longitudinal movement. When the trigger is activated, pressurized air from the ballast chamber is delivered to the firing chamber. Because the surface area of the firing piston is greater than the ballast piston's surface area, the force exerted on the firing piston is sufficient to displace the ballast piston and allow pressurize air to be released into the upper chamber containing the projectile.

18 Claims, 15 Drawing Sheets

(51) Int. Cl.
*F41B 11/724* (2013.01)
*F41B 11/54* (2013.01)
*F41B 11/62* (2013.01)

(58) Field of Classification Search
CPC ..... F41B 11/723; F41B 11/64; F41B 11/50; F41B 11/724
See application file for complete search history.

(56) References Cited

U.S. PATENT DOCUMENTS 5,680,853 A * 10/1997 Clayton ..... F41B 11/54 124/59
5,709,199 A * 1/1998 Johnson ..... F41B 11/54 124/48
5,724,955 A * 3/1998 Johnson ..... F41B 11/54 124/48
5,787,869 A * 8/1998 Johnson ..... F41B 11/54 124/69
5,878,734 A * 3/1999 Johnson ..... F41B 11/54 124/59
5,878,735 A * 3/1999 Johnson ..... F41B 11/54 124/59
5,913,304 A * 6/1999 Johnson ..... F41B 11/721 124/48
5,924,413 A * 7/1999 Johnson ..... F41B 11/54 124/72
6,000,386 A * 12/1999 Johnson ..... F41B 9/0018 124/69
6,003,503 A * 12/1999 Johnson ..... F41B 9/0018 124/69
6,152,125 A * 11/2000 Piper ..... F41A 9/36 124/59
6,364,162 B1 * 4/2002 Johnson ..... F41B 9/0018 222/61
8,430,085 B2 * 4/2013 Tippmann, Sr. ..... F41B 11/00 124/48
2006/0107939 A1 * 5/2006 Dobbins ..... F41B 11/724 124/73
2006/0225718 A1 * 10/2006 Kirwan ..... F41B 11/721 124/71
2006/0266342 A1 * 11/2006 Teipel ..... F41B 11/54 124/74
2011/0186026 A1 * 8/2011 Tippmann, Sr. ..... F41B 11/00 124/73

FOREIGN PATENT DOCUMENTS

WO WO 8601679 A2 * 3/1986 ..... F41B 11/51
WO WO 2015057281 A2 * 4/2015 ..... F41B 11/60

* cited by examiner

PROJECTILE DELIVERY SYSTEM WITH VARIABLE VELOCITY CONTROL

TECHNICAL FIELD

This invention pertains to a pneumatic launcher.

BACKGROUND ART

Non-lethal launchers, both pneumatic and gun powder-based, are used to shoot projectiles such as tear gas cartridges, pepper spray cartridges, stun ammo or smoke cartridges to name a few. More recently, electro muscular incapacitation ammunition has been developed that shoots an electronic projectile which delivers a high voltage, low amperage shock that immobilizes an individual upon impact.

The projectiles used in a non-lethal launcher vary in weight and size. Most launchers use a preset pressure or charge to deliver a desired type of projectile at a safe velocity. Some pneumatic launchers have adjustable regulators that allow the launchers to be set up prior to use for a specific velocity of the projectile. In gun powder-based launchers the ammunition must be exchanged to provide a different velocity for the projectile.

In actual use, multiple targets are often presented to the operator. The targets may be a fixed area, object or an individual within the launcher's recommended range. Sometimes, the target may be outside the launcher's recommended range. If the target is moving, it may also be advancing or retreating from the operator. Sometimes, the operator may be moving towards or away from the target area or the target. In each instance, the operator must quickly identify the target, determine if it is fixed or moving, and then determine if the target is within a safe range for firing the launcher.

When controlling a crowd, operators may have to shoot different projectiles at different ranges. If each launcher is setup for use with one type of projectile or velocity, a single launcher cannot be used without injuring the target. The system allows the operator to adjust the velocity for each individual shot without the need to raise or lower the pressure, vent gas away from the projectile, or exchange ammunition. Incorporated with a laser or acoustic range finder, the system becomes automated based on range to target.

Other variable velocity weapon systems that have used laser range finders have previously been limited by their high cost of operation due to elaborate gas metering or use of gun powder.

What is needed is a pneumatic launcher system that allows an operator to easily and quickly control the muzzle velocity of projectiles and enabling projectiles of different types and weights to be safely delivered to a desired target or target area.

DISCLOSURE OF THE INVENTION

It is therefore an object of the present invention to provide a projectile delivery system that includes a pneumatic launcher apparatus for launching projectiles that addresses the problems described above.

More specifically, the system comprises a launcher with at least one round chamber capable of being filled with a projectile. In other embodiments, the launcher is configured to repeatedly position a plurality of projectiles into a discharge position. The launcher includes a main tube containing a closed ballast chamber filled with pressurized air from an external pressurized air source. Located adjacent to the main tube is a set of valve plates and a velocity housing. Mounted or formed on the velocity housing is an external air fitting that connects to an external pressurized air source. Air conduits extend from the velocity housing to the ballast chamber to fill the ballast chamber with pressurized air.

The two valve plates are located in front of a piston sleeve. Extending longitudinally through the piston sleeve and through the two valve plates is a piston rod. The proximal end of the piston rod extends into the valve housing and the distal end of the piston rod extends into the ballast chamber. After assembly, the middle section of the piston rod extends through a firing chamber. Attached to the middle section of the piston rod is a firing piston. The proximal end of the piston rod extends into the velocity housing and interconnects with a velocity valve that includes a stop guide and stop key. A movable stop ring is mounted on the outer surface of the valve housing that controls the position of the stop guide and the movement of a piston rod.

When external pressurized air source is connected to the fitting, pressurized air is delivered to the valve housing and then bled to the ballast chamber. The user manually adjusts or the system automatically adjusts the velocity valve to control the longitudinal movement of the piston rod and the amount of pressurized air delivered to the discharge chamber containing the projectile. When the trigger is activated, a portion of the air from the ballast chamber is delivered to the firing chamber. The firing piston located inside the firing chamber has a larger surface area than the ballast piston causing the piston rod to move longitudinally forward and release air from the ballast chamber. In one embodiment, pressurized air from the ballast chamber is released into an intermediate conduit and eventually flows into the discharge chamber in the barrel and forces the projectile out of the muzzle.

In one embodiment, the launcher is a revolver that includes an index assembly that includes a linear actuator that uses a portion of the pressurized air initially released from the ballast chamber to force the linear actuator to move to an extended position and then automatically retract to its original position while indexing the revolving cylinder.

BEST MODE FOR CARRYING OUT THE INVENTION

Figures 1, 2:
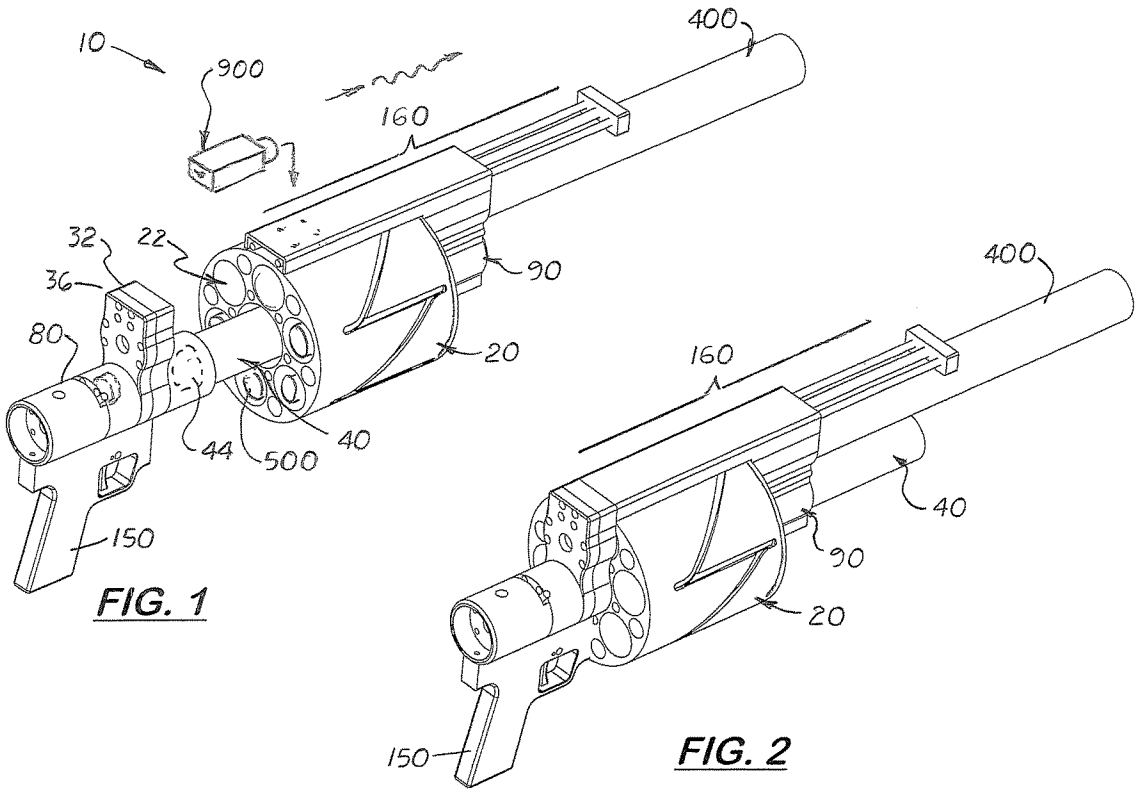
FIG. 1 is a perspective view of the pneumatic launcher in an extended position.
FIG. 2 is a perspective view of the pneumatic launcher in a retracted position.
Figure 3:
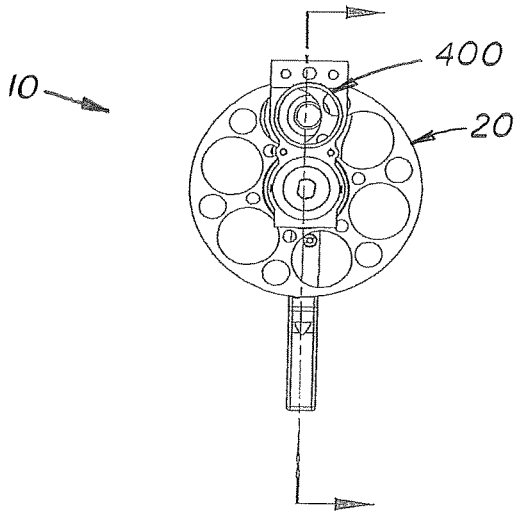
FIG. 3 is a front elevational view of the pneumatic launcher with the front cover plate removed.
Figure 4:
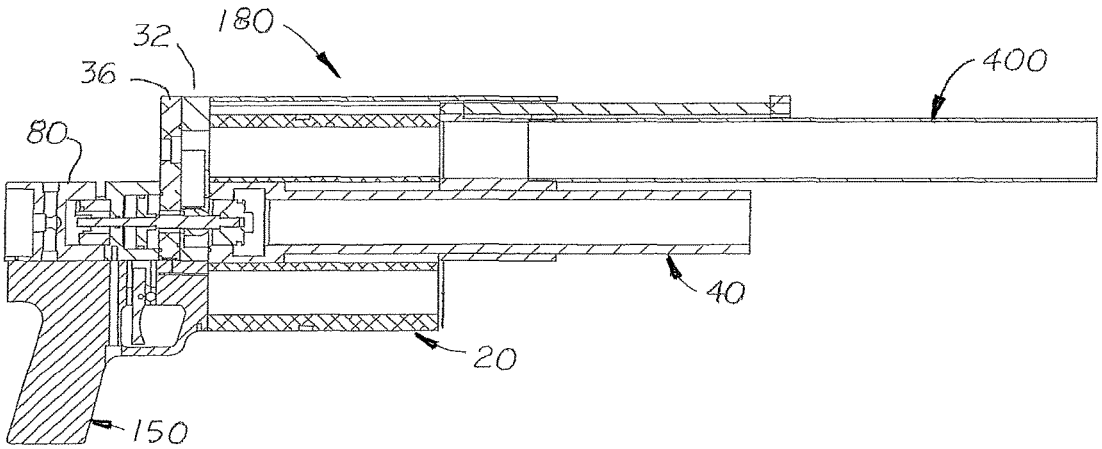
FIG. 4 is a sectional side elevational view of the pneumatic launcher.
Figure 5:
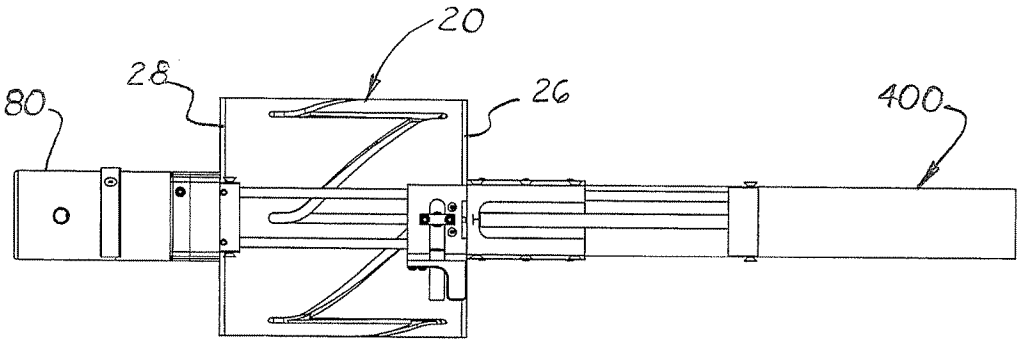
FIG. 5 is a top plane view of the pneumatic launcher.
Figure 6:
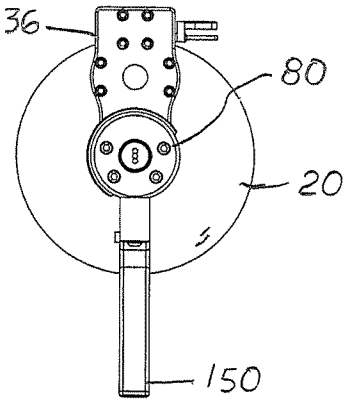
FIG. 6 is a rear elevational view of the pneumatic launcher.
Figure 7:
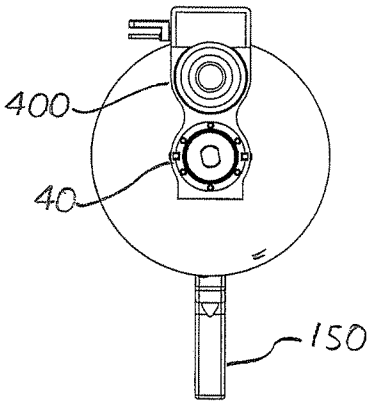
FIG. 7 is a front elevational view of the pneumatic launcher.

Referring to the FIGS. 1-24, there is shown a variable velocity pneumatic launcher 10 that includes a cylinder drum 20 with a plurality of round chambers 22 each capable of being filled with a projectile 500. The cylinder drum 20 is configured to slide longitudinally over a fixed main tube 40 with an internal ballast chamber 44 formed near its proximal end filled with pressurized air greater than ambient, atmospheric air.

Figure 9:
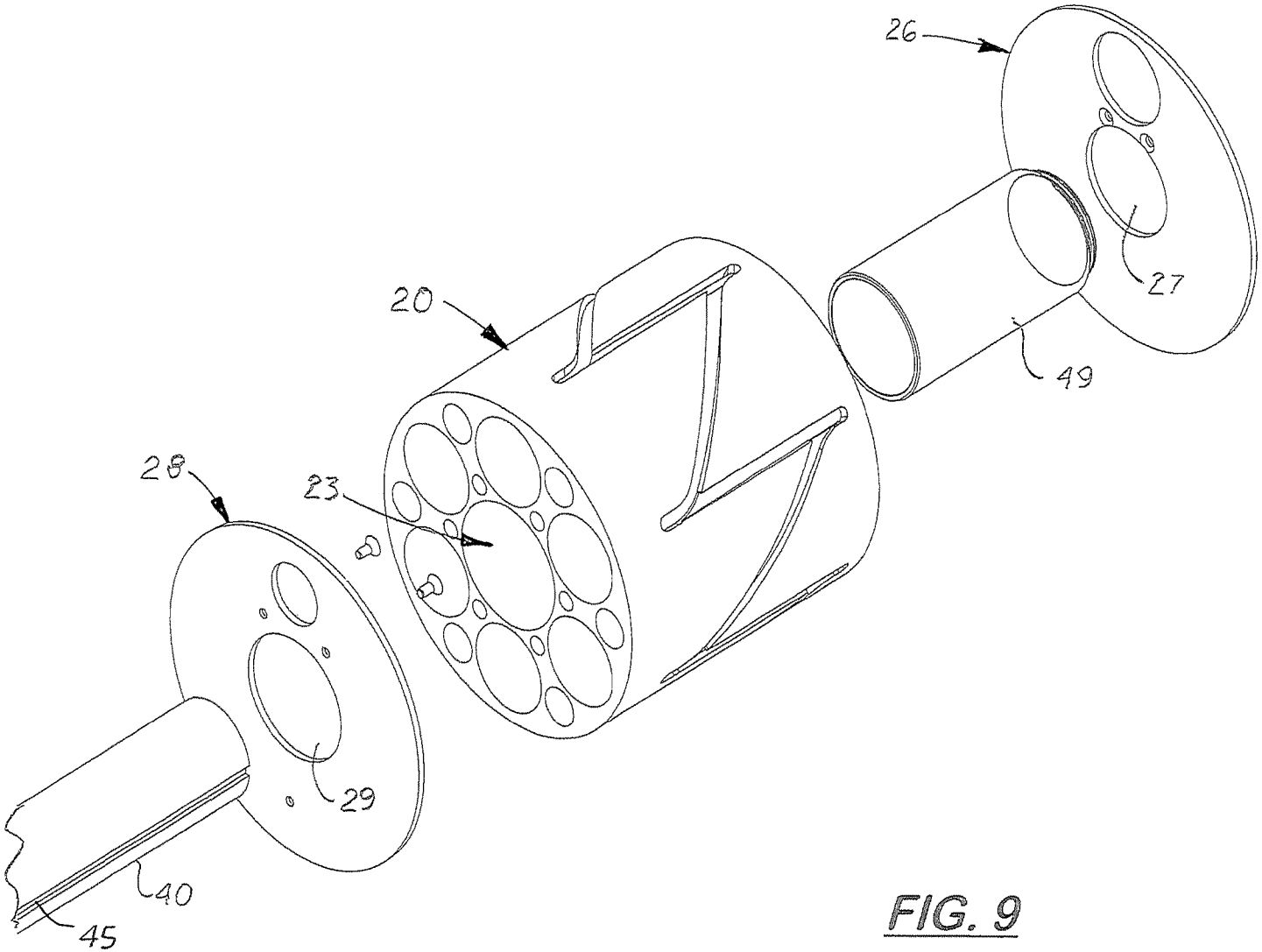
FIG. 9 is an exploded, partial perspective view of the main tube, the rear cover plate, the cylindrical drum, the cylindrical sleeve, and the front cover plate.
Figure 13:
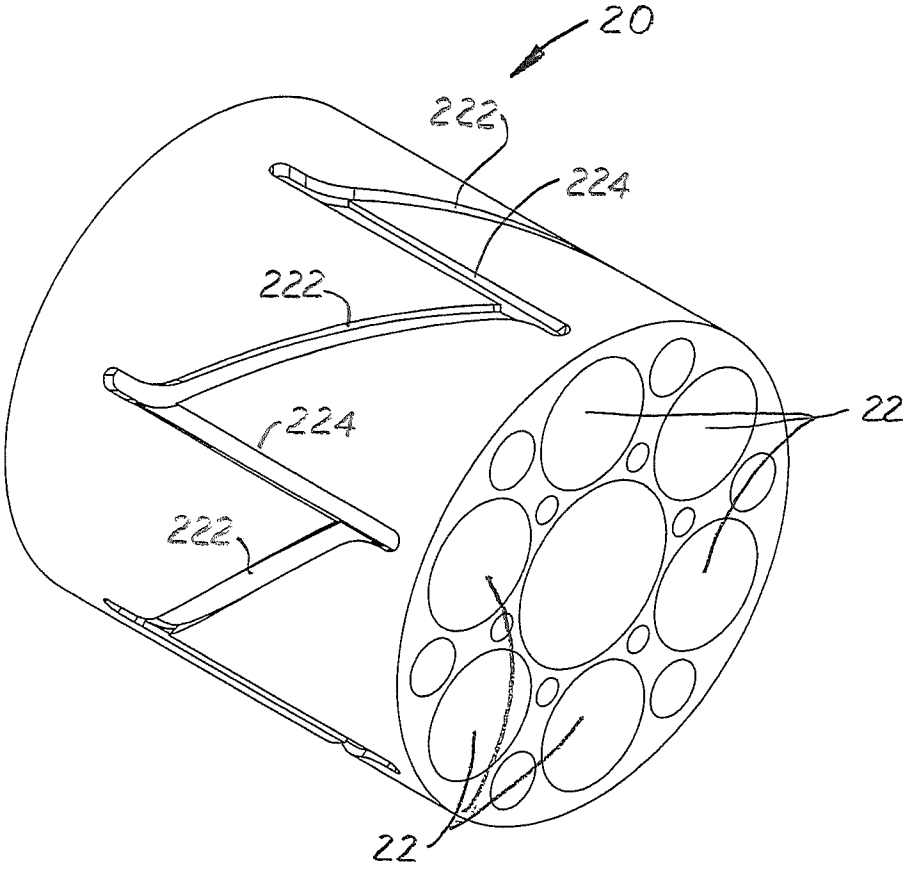
FIG. 13 is a perspective view of the cylindrical drum.

In one embodiment, the front surface of the cylinder drum 20 is attached to a slide body 90 configured to slide freely over a main tube 40. As shown in FIGS. 9 and 13, the cylinder drum 20 includes a center bore 23 that receives an inner cylinder sleeve 49 affixed to a slide body 90. During assembly, the main body 40 fits into the cylinder sleeve 49. Formed on the outside side of the main body 40 is at least one keyway 45 that receives a key 97 formed on the slide body 90, (see FIG. 14).

Figure 14:
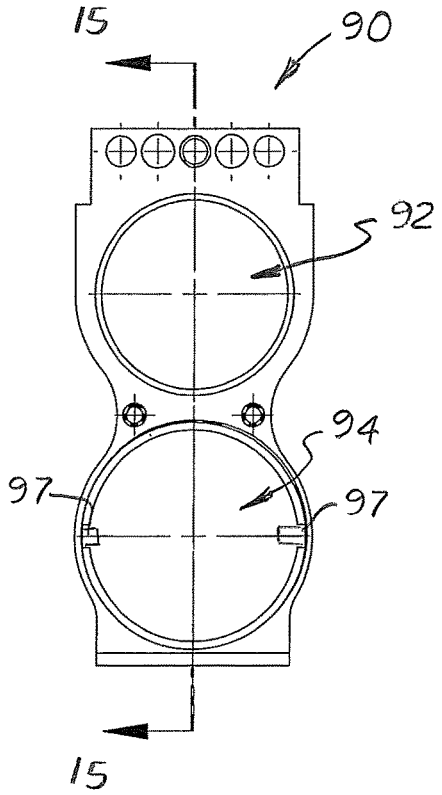
FIG. 14 is a rear elevational view of the slide body.
Figure 15:
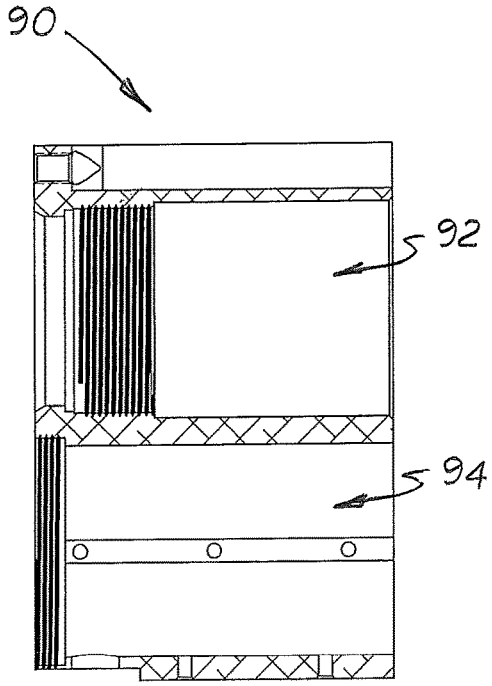
FIG. 15 is a sectional side elevational view of the slide body taken along line 15-15 in FIG. 14.
Figure 16:
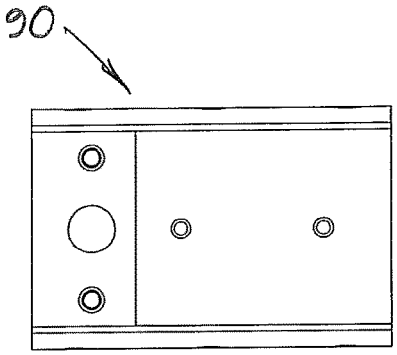
FIG. 16 is a top plan view of the slide body.
Figure 17:
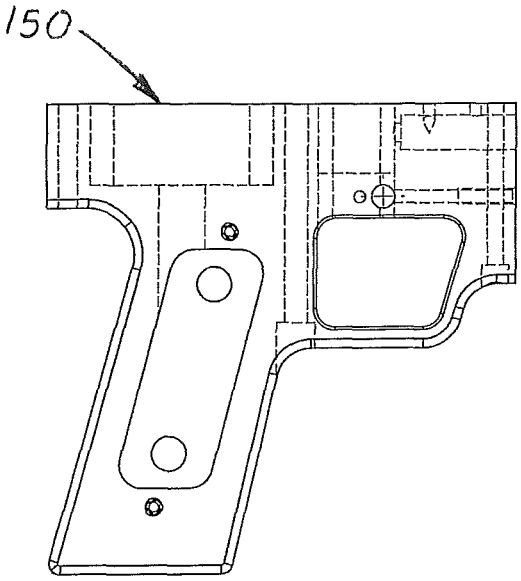
FIG. 17 is a side elevational view of the hand grip.
Figure 18:
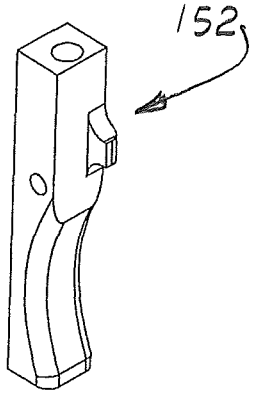
FIG. 18 is a perspective view of the trigger.
Figure 19:
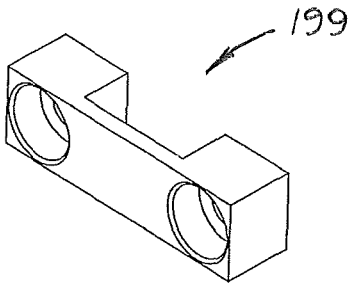
FIG. 19 is a perspective view of the index spring retainer.

Attached to the upper end of the slide body 90 is an optional index assembly 180 that automatically rotates the cylinder drum 20 after each shot and also positions the next round chamber 22 containing a projectile 500 into an upper position longitudinally aligned with the longitudinal axis of the barrel 400. A barrel 400 is affixed to the slide body 90 and extends through a barrel opening 92 formed on the slide body 90. As shown in FIGS. 14-16, the slide body 90 includes a lower main tube opening 94 that allows the cylinder drum 20 and the slide body 90 to slide as a unit longitudinally over the fixed main tube 40 during operation.

Figure 10:
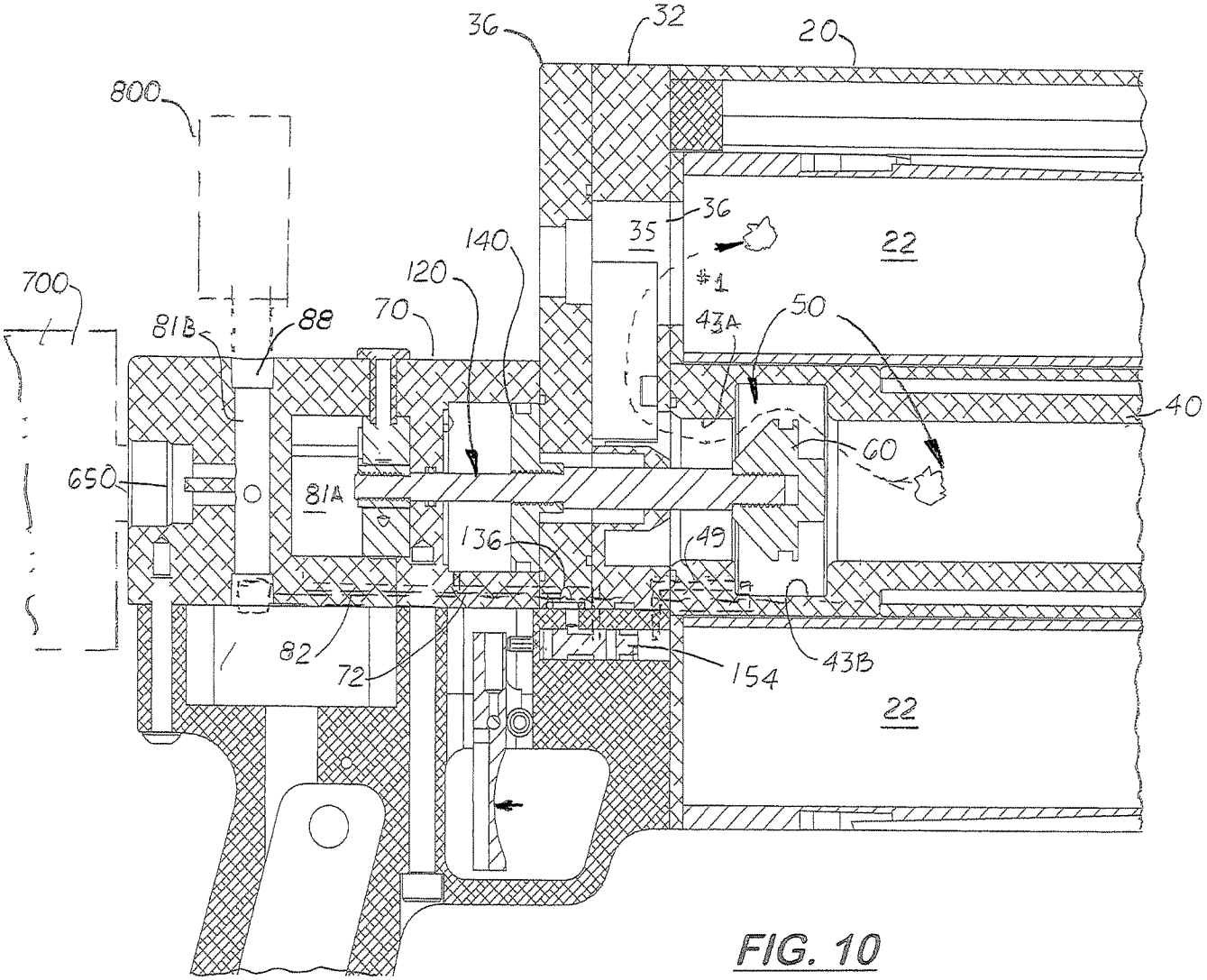
FIG. 10 is a sectional side elevational view of the proximal end of the pneumatic launcher showing the ballast piston in an open position.
Figure 11:
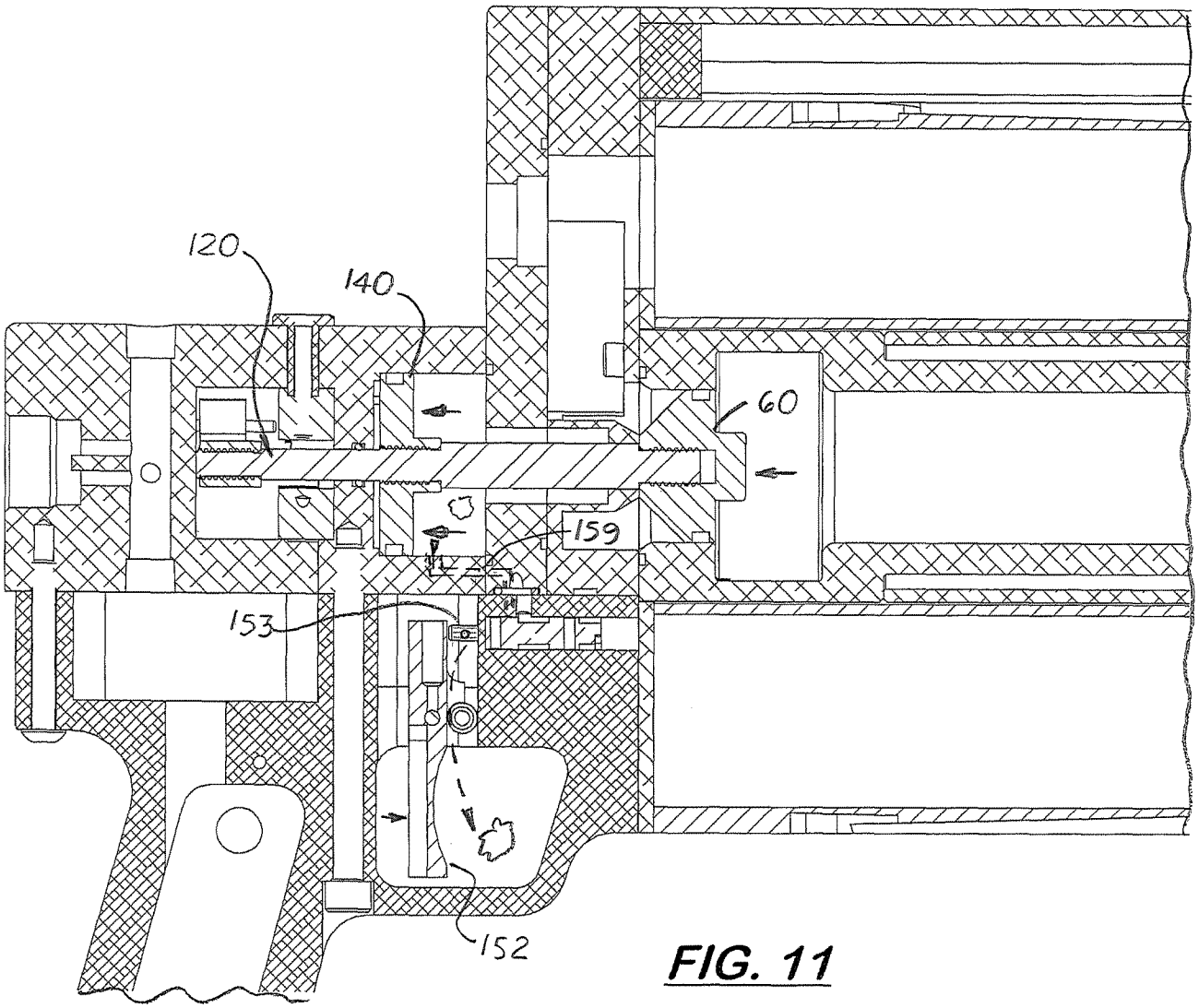
FIG. 11 is a sectional side elevational view of the proximal end of the pneumatic launcher showing the ballast piston in a closed position.
Figure 12:
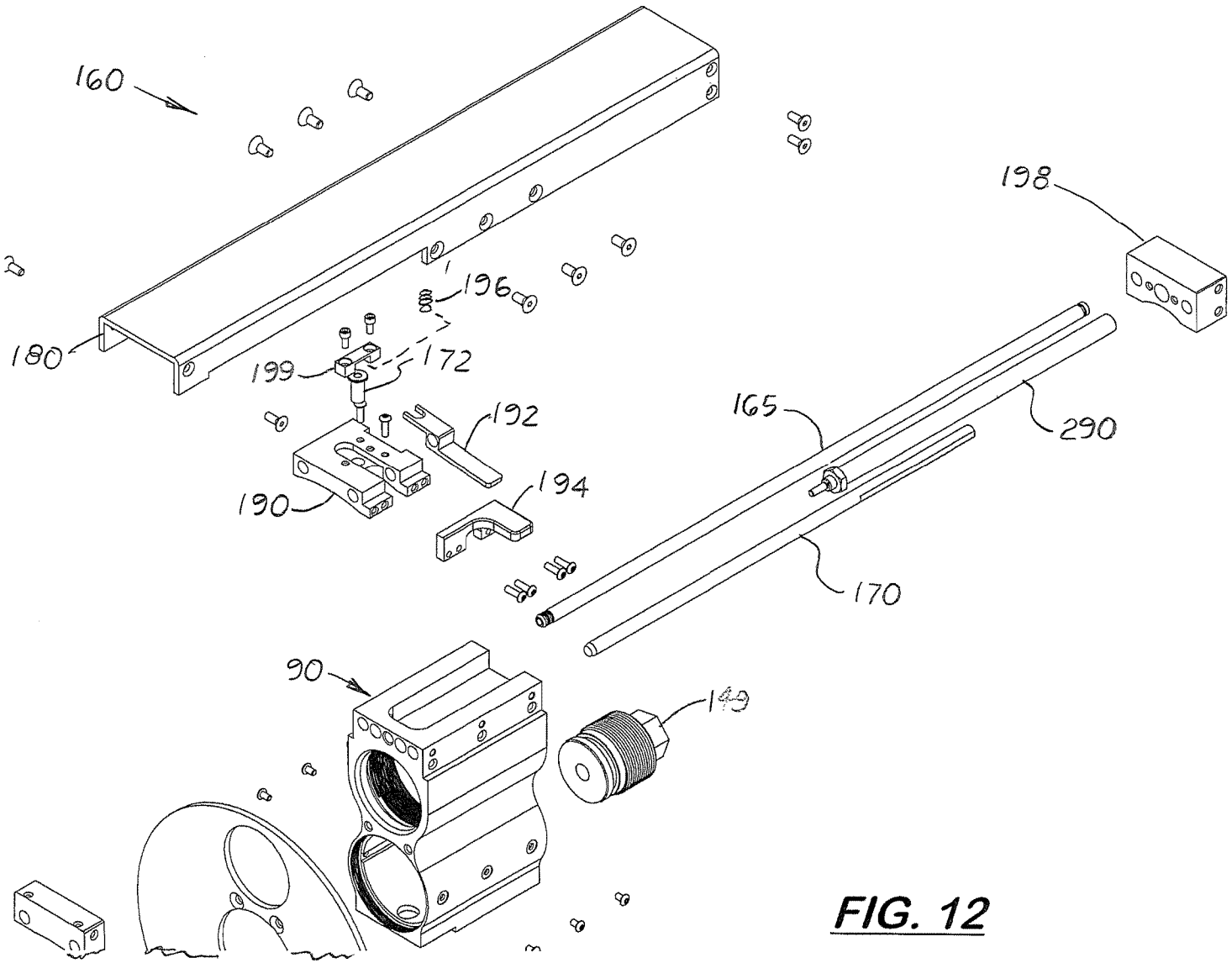
FIG. 12 is an exploded perspective view of the index assembly.

As also shown in FIG. 9, mounted over the opposite ends of the cylinder drum 20 is a front cover plate 26 and an optional rear cover plate 28. The front cover plate 26 is attached to the rear surface of the slide body 90 and the rear cover plate 28, when used, is attached to the first valve plate 32. When the launcher 10 is closed, the first valve plate 32 and a second valve plate 36 are aligned parallel and positioned over the top surface of a hand grip 150 located behind the cylinder drum 20 as shown in FIGS. 10 and 11.

Figure 8:
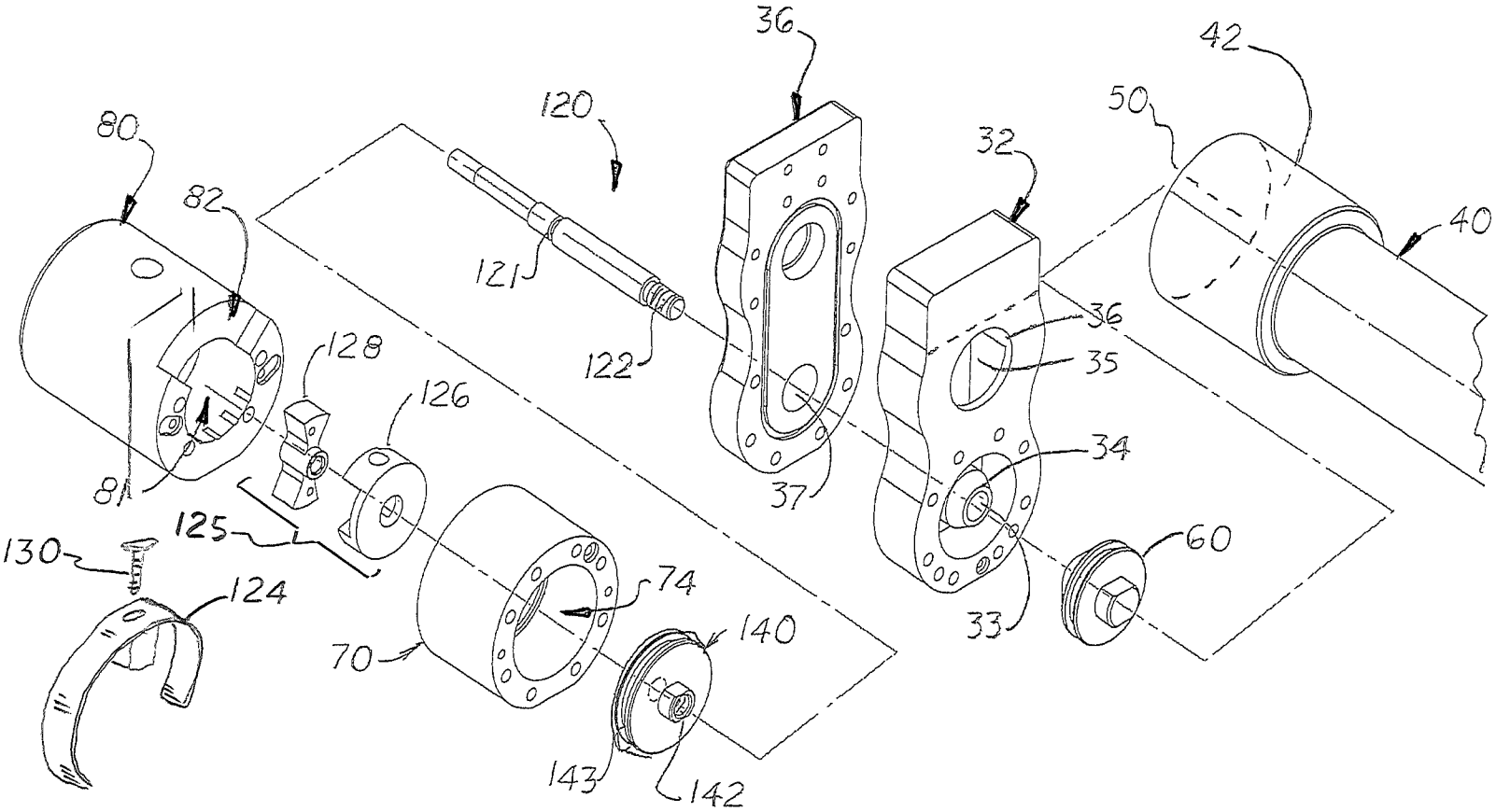
FIG. 8 is an exploded, partial perspective view showing the velocity housing, the stop key, stop guide, piston sleeve, firing piston, piston rod, valve plates, ballast piston and the main tube.
Figure 20:
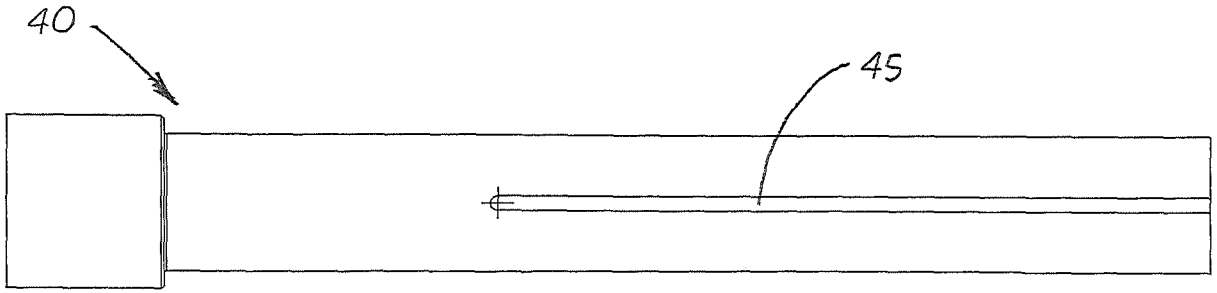
FIG. 20 is a side elevational view of the main tube showing a longitudinally aligned keyway formed on the outer surface.
Figure 21:
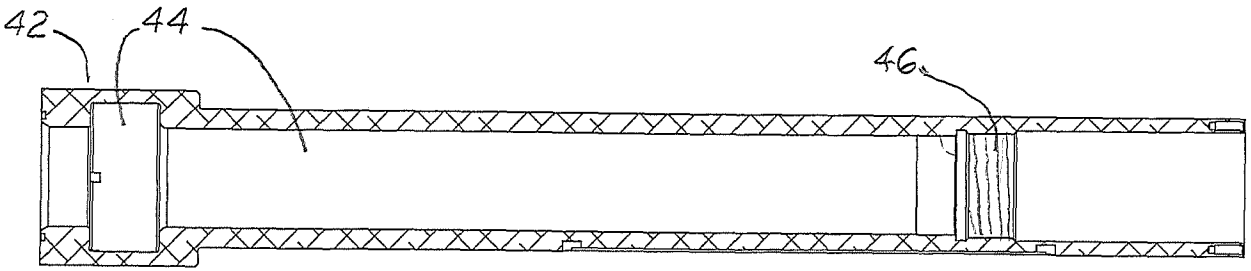
FIG. 21 is a sectional side elevational view of the main tube shown in FIG. 20 showing the ballast chamber and the end plug threads.
Figure 22:
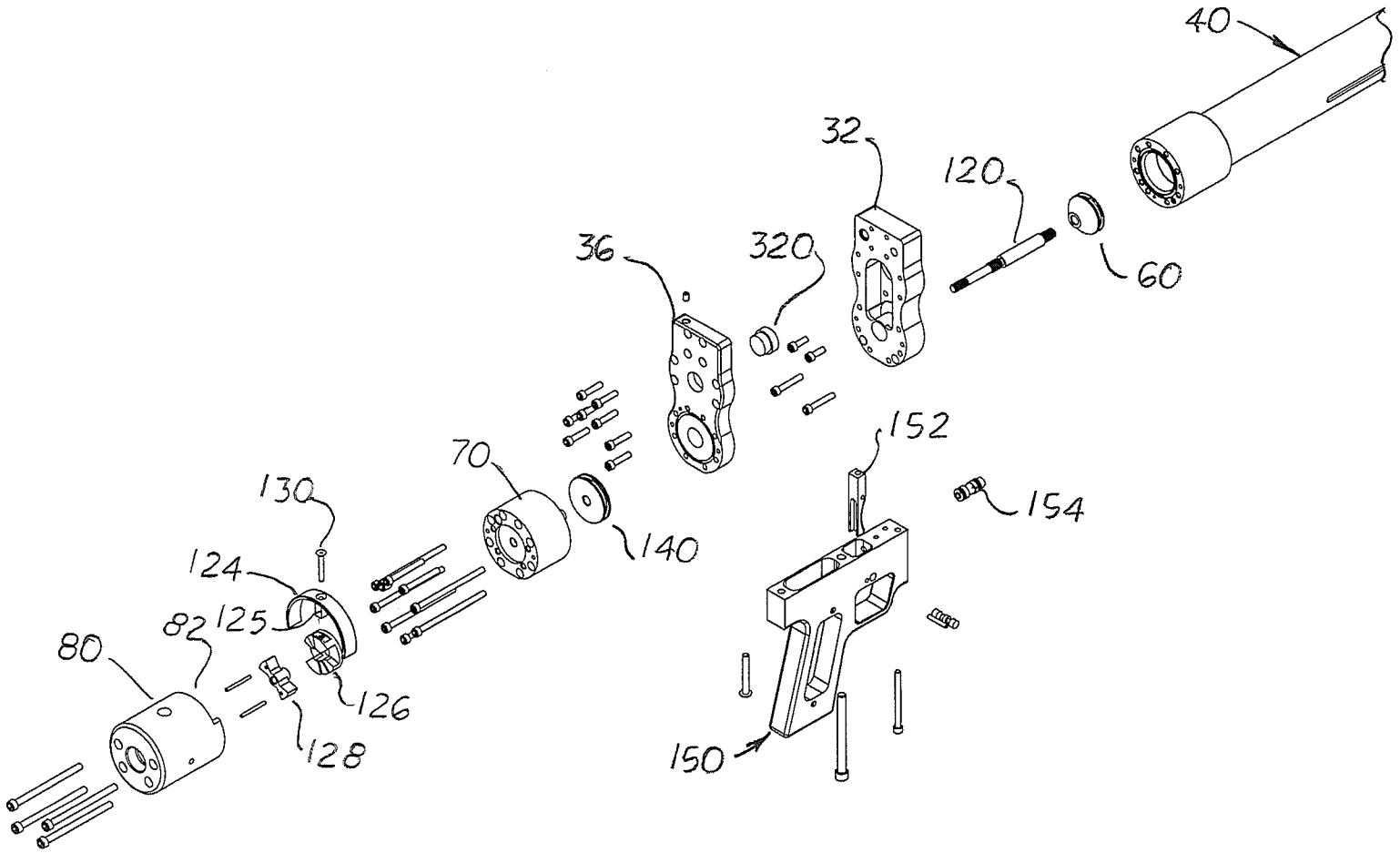
FIG. 22 is an exploded perspective view of the pneumatic launcher
Figure 23:
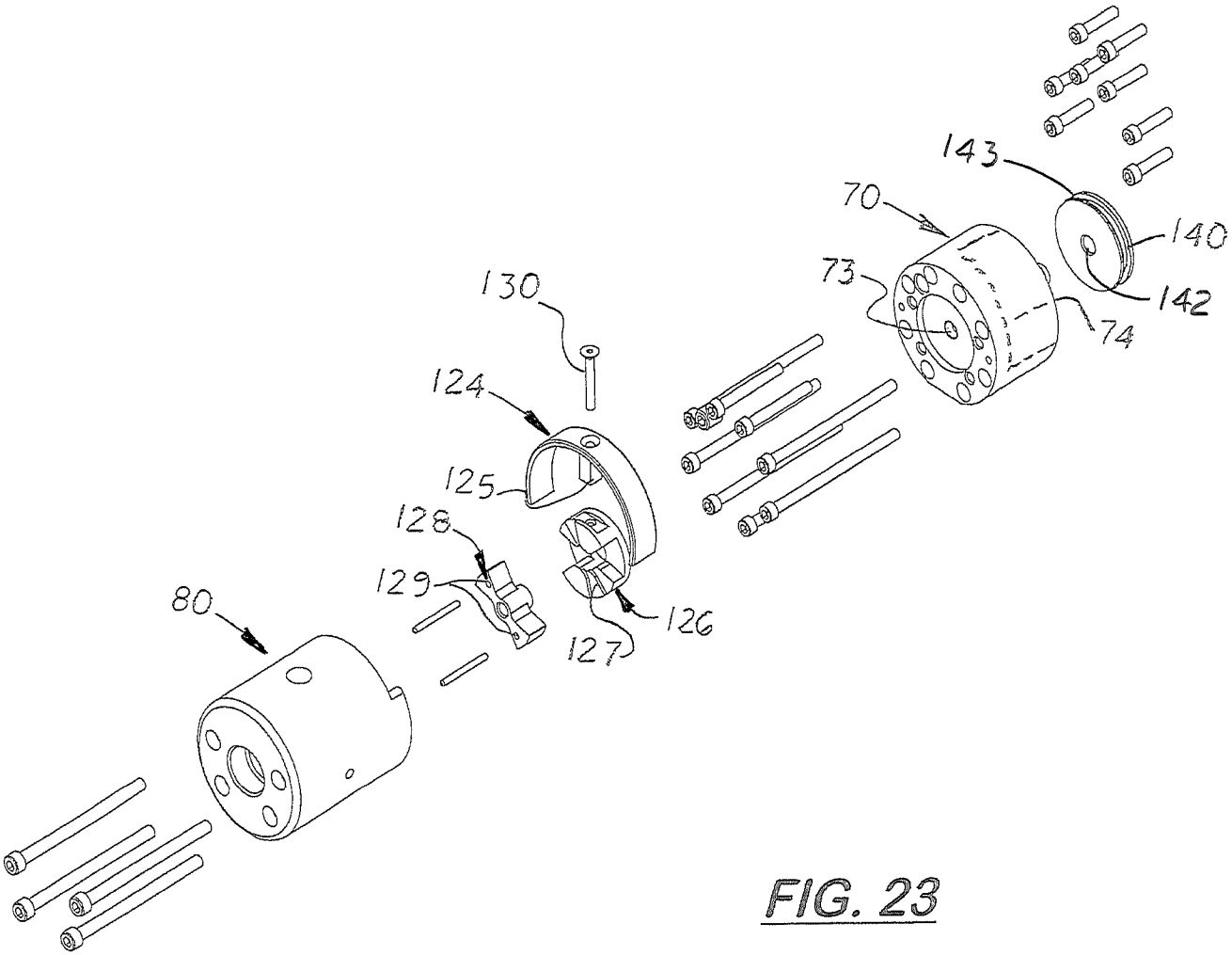
FIG. 23 is an exploded perspective view of the proximal end of the pneumatic launcher.
Figure 24:
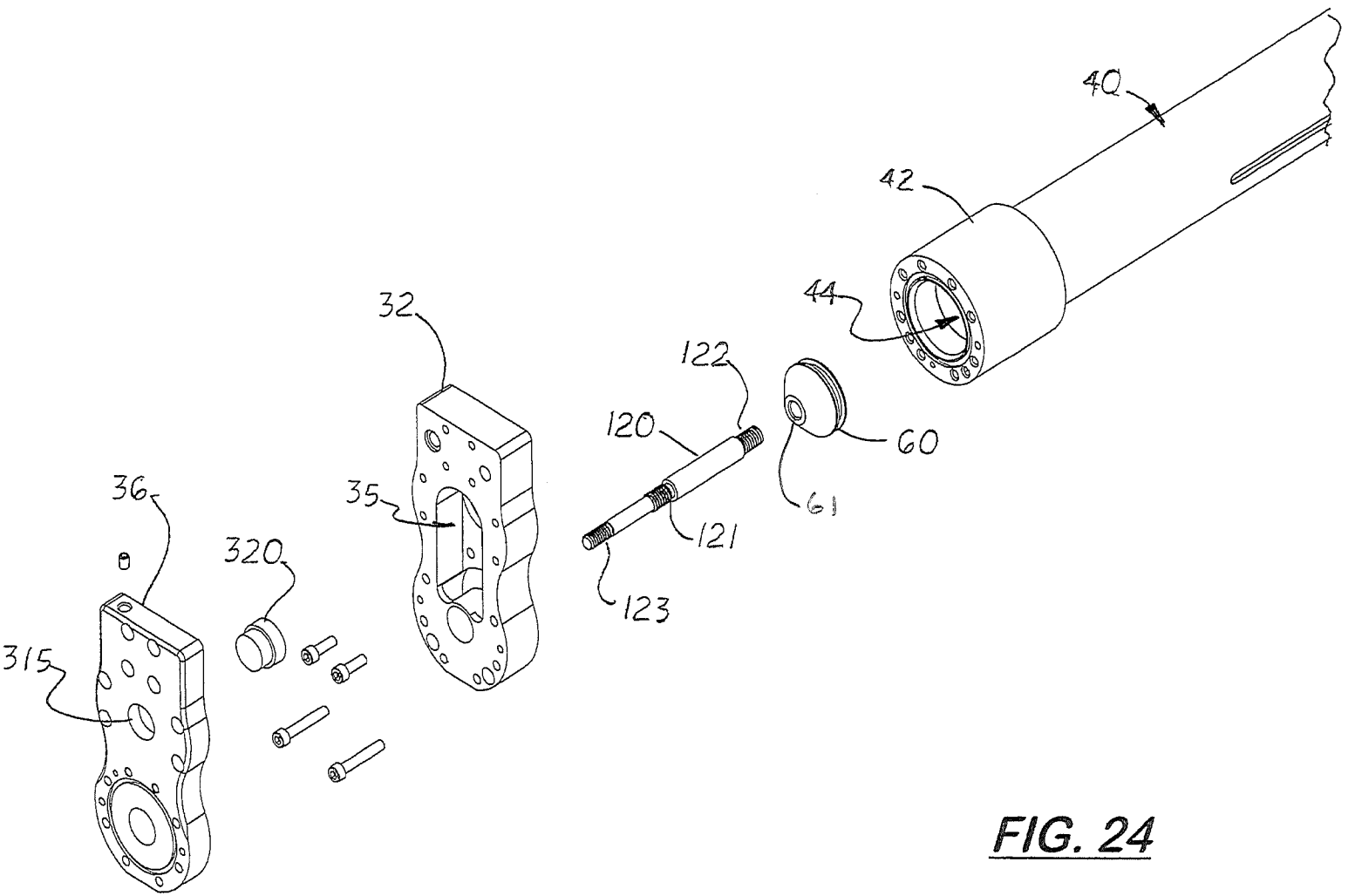
FIG. 24 is an exploded perspective view of the middle section of the pneumatic launcher.

The proximal end of the main tube 40 connects to the front surface of the first valve plate 32 and extends longitudinally through central bores 27, 29 formed on the front and rear cover plates 26, 28, and through the cylinder sleeve 49, respectively. As shown in FIG. 8, the main tube 40 includes a wide receiver neck 42 that attaches to the front surface of the first valve plate 32. The main tube 40 is hollow with a sealing end plug 149 (see FIG. 12) attached to internal threads 46 formed near the distal end. The inner area extending from the receiver neck 42 opposite the end plug 149 is a ballast chamber 50. Formed inside the wide inner space inside the receiver neck 42 is a ballast piston 60. The receiver neck 42 includes a short bore section 43A and a short wide bore section 43B. The ballast piston 60 is a conical-shaped object shown in FIGS. 10 and 11 with diverging end walls and an outer o-ring 63 that press against the inside surface of the short bore section 43A to seal off the ballast chamber 50. The ballast chamber 50 is formed inside the main tube 40 and closed off at one end by the end plug 46 and at the opposite end by the ballast piston 60 as shown in FIG. 20.

Mounted on the top of the hand grip 150 and rearward from the piston sleeve 70 is a velocity housing 80 as shown in FIG. 8. Formed inside the velocity housing 80 is a first inner valve cavity 81A, (see FIG. 10). Located inside the first inner valve cavity 81A is a velocity valve 125 that includes a stop guide 126 and stop key 128 discussed further below. Mounted or formed on the rear external surface of the velocity housing 80 is an external air pressure fitting 650. The fitting 650 communicates with the second inner valve cavity 81B. Also, formed on the velocity housing 80 is a gauge port 88 that connects to an optional air pressure gauge 800. Formed on the velocity housing 80 is at least one longitudinally aligned air conduit 82 that communicates with the second valve cavity 81B and with an air conduit 72 formed on the piston sleeve 70. The air conduit 72 terminates in a cavity that holds a poppet valve 154 located in the hand grip 150. Located in the distal end of the main body 40 is an air conduit 49 that extends between the ballast chamber 50 and the poppet valve cavity that holds the poppet valve 154.

Extending longitudinally from the velocity housing 80 through the piston sleeve 70, through the two valve plates 32, 36 and into the ballast chamber 50 in the main tube 40 is a piston rod 120. As shown in FIG. 10, the rear valve plate 36 includes an air conduit 136 that communicates with the air conduit 72 in the piston sleeve 70. The proximal end of the piston rod 120 is disposed inside the valve cavity 81 and connects to the stop key 128. Mounted on the outer surface of the velocity housing 80 is an outer, semi-circular stop ring 124, (see FIG. 22). Located inside the velocity housing 80 is the stop guide 126 and the stop key 128. The rear valve plate 36 also includes an optional bore with a polycarbonate window 320 inserted therein. During use, the user may view through the window 320 see inside the chamber 22 to determine if a projectile 500 is inside the chamber 22 when operating the launcher 10.

The stop ring 124 is a semi-circular structure positioned over a semi-circular slot 82 formed on the outer surface of the velocity housing 80. The stop guide 126 and the stop key 128 are located inside the velocity housing 80. The stop ring 124 is configured to move transversely or side-to-side inside a transversely aligned slot 82 formed on the velocity housing 80. Formed or attached to the bottom surface of the stop ring 124 is a downward extending leg 125. During assembly, a threaded bolt 130 is extended through a bore formed on the velocity housing 80 that extends through the extending leg 125.

Located inside the longitudinally aligned bore 81 formed in the velocity housing 80 and below the stop ring 124 is the cylindrical stop guide 126. Formed on the inside surface of the stop guide 126 are platforms 127 (see FIG. 23) configured to selectively engage two arms 129 located on the stop key 128 that is coaxially aligned and disposed inside the stop ring 124. The stop key 128 fits inside the center bore formed on the stop guide 126. The stop key 128 is mounted in a fixed position on the proximal end of the piston rod 120. During operation, the stop guide 126 is connected to the threaded bolt 130 that extends downward from the stop ring 124. When the stop ring 124 is moved laterally over the velocity housing 80, the stop guide 126 rotates over the stop key 128. The rotational movements of the platforms 127 relative to the arms 129 on the stop key 128 control the longitudinal movement of the piston rod 120 and the longitudinal movement of the ballast piston 60.

As state above, the piston sleeve 70 includes a center bore 73 through which the piston rod 120 extends and rotates and slides freely. Formed inside the piston sleeve 70 is piston cavity 74 in which the firing piston 140 is disposed. The firing piston 140 includes internal threads 142 that mesh with external threads 121 formed on the middle region of the piston rod 120 that enables the firing piston 140 to be locked in a fixed position on the piston rod 120. An o-ring 143 is attached to the outer perimeter of the firing piston 140 to create a sealed enclosed firing chamber 74 against the inside surface of the piston sleeve 70.

The piston rod 120 extends forward from the firing piston 140 through bores 33, 37 formed on the first and second valve plates 32, 36, respectively. Formed inside the bore 33 formed on the first valve plate 32 is an aligned neck 34 that co-axially aligns the piston rod 120 with the center axis of the main tube 40.

The distal end of the piston rod 120 is connected to a threaded bore 61 formed on the end surface of the ballast piston 60 disposed inside the ballast chamber 50 formed on the main tube 40. During operation, the ballast chamber 50 is filled with pressurized air (approx. 300 psi and the ballast piston 60 is automatically forced rearward closing the ballast chamber 50.

The index assembly 160 is attached to the slide body 90 and supported over the main tube 40. The index assembly 160 includes a hollow index tube 165 and an index rod 170 and an index slider 190. During operation, the index slider 190 slides longitudinally back and forth over the index tube 165 and the index rod 170.

The index assembly 160 also includes a spring biased pin 172 that extends downward and engages spiral grooves 222 and slots 224 formed on the side of the cylinder drum 20. The spiral grooves 222 and slots 224 extend continuous over the outside surface of the cylinder drum 20. When the index assembly 160 slides forward, the pin 172 is forcibly pressed downward against a spiral grooves 222 causing the cylinder drum 20 to rotate in a clockwise direction to position the next adjacent chamber on the cylinder drum 20 in a discharge position and in alignment with the barrel 400. The slots 224 allow the cylinder drum 20 to slide longitudinally.

The hand grip 150 includes a trigger 152 coupled to a poppet valve 154. When the trigger 152 is pulled, the poppet valve 154 causes a portion of the pressurized air in the ballast chamber 50 to escape and flow into the firing chamber 74.

A 3,000-4500 PSI external air source 700 is connected to an external air fitting 650 formed on the velocity housing 80. The air source 700 includes a regulator that lowers the air pressure to approximately 300 psi. The pressurized air follows air conduits 82, 72 and 136 formed in the velocity housing 80, the piston sleeve 70 and the first valve plate 32, respectively. The pressurized air is delivered to the poppet valve cavity and then to the ballast chamber 50. When the pressurized air is delivered to the ballast chamber 50, the ballast piston 60 is forced rearward against the narrow inside bore 43A formed on the distal end of the main tube 40.

The firing piston 140 located inside the firing chamber 74 located inside the piston sleeve 70 has a surface area larger than the surface area of the ballast piston 60. When the poppet valve 154 is opened, pressurized air is delivered to the firing chamber 74 causing the firing piston 140 to move longitudinally inside the firing chamber 74. Because the firing piston 140 is affixed to the piston rod 120, adding pressurized air to the firing chamber 74 causes the piston rod 120 to move longitudinally forward through the two valve plates 32, 36 and the main tube 40. The force exerted by the piston rod 120 overcomes the air pressure inside the ballast chamber 50 causing the ballast piston 60 to move forward and allow pressurized air to escape and flow around the ballast piston 60 and into an interior cavity 35 formed on the front valve plate 32, The interior cavity 35 includes a bore 36 that communicates with the upper chamber 22 in the cylinder drum 20 containing a projectile 500 forcing the projectile 500 from the barrel 400. How far the ballast piston 60 opens controls the amount of pressurized air released from the ballast chamber 50. If the ballast piston 60 is forced open entirely, substantially all of the pressurize air is released into the upper chamber 22 and the projectile 500 exits the barrel 400 at its maximum velocity. If the ballast piston 60 is partially opened, then a reduced amount of pressurized air is released into the upper chamber 22 and the projectile 500 exits the barrel 400 at a lower velocity.

When the trigger 152 is released, the trigger plunger 153 is extended which allows pressurized air inside the firing chamber 140 to travel through one or more air conduits 159 formed in the piston sleeve 70 and terminates in the poppet valve cavity in the hand grip 150. Air from the firing chamber 140 escapes into the atmosphere.

As mentioned above, the launcher 10 may include an optional index assembly 160 that causes a cylinder drum 20 to automatically rotate so the upper chamber is aligned with the barrel 400. The index assembly 160 is coupled to the ballast chamber 50 so pressurized air is used to impart movement of the cylindrical drum 20.

More specifically, pressurized air is delivered to the index tube 165 and is released into an air piston cylinder 290 which causes the indexing slider 190 to move backwards over the index tube 165 and index rod 170. The index assembly 160 includes an index cover 180 that covers the index tube 165 and the index rod 170. The distal ends of the index tube 165, the index rod 170 and the cylinder 290 are attached to an index end cap 198. The index cover 160 is attached to the slide body 90. Located under the index cover 180 is a spring biased index pin 187 connected to an index slider 190. Connected to the index slider 190 is an index lever 192 and an index handle 194. When pressurized air is delivered to the index tube 165, the index slider 190 is forced backwards over the index tube 165 and index rod 170. The index lever 192, the index handle 194 and the index spring 196 forces the pin downward which causes the cylinder drum 20 to rotate 60 degrees upon return so that the next chamber is aligned with the barrel 400.

In the embodiment described above and shown in the Figures, the user manually manipulates the stop ring 124 to adjust the movement of the piston rod 120 during operation It should be understood that an alternative mechanical component, such as an electric motor coupled to a laser range finder 900 may be attached to the velocity housing 80 that automatically adjusts the velocity valve according to the distance to the target.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

INDUSTRIAL APPLICABILITY

This invention has application in the military and law enforcement industries and more specifically, to crowd control tactics.

I claim:

1. A pneumatic launcher, comprising:

a. a barrel;

b. at least one round chamber filled with a projectile and longitudinally aligned with said barrel;

c. a ballast chamber;

d. a ballast piston located inside said ballast chamber, said ballast piston configured to close said ballast chamber when said ballast chamber is filled with pressurized air greater than ambient air pressure;

e. a piston sleeve, said piston sleeve including a firing chamber and a firing piston located inside said firing chamber;

f. a velocity housing attached to said piston sleeve, said velocity housing includes a valve cavity;

g. a trigger;

h a poppet valve coupled to said trigger;

i a piston rod extending longitudinally from said valve cavity, into said firing chamber in said piston sleeve and into said ballast chamber, said piston rod affixed to said firing piston and affixed to said ballast piston so that when said piston rod moves longitudinally, said firing piston and said ballast piston move simultaneous and allows pressurized air to flow from said ballast chamber and into said round chamber;

j. an adjustable velocity valve located inside said velocity cavity and coupled to said piston rod that selectively controls the longitudinal movement of said piston rod and the movement of said ballast piston and said firing piston;

k. at least one air conduit extending between said poppet valve and said firing chamber;

l. an air pressure source connected to said ballast chamber, and, m. an air pressure source attached to said poppet valve.

2. The launcher, as recited in claim 1, wherein said adjustable velocity valve includes a stop ring mounted on said velocity housing, a stop guide located inside said valve cavity and attached to said stop ring and a stop key affixed to said piston rod, said stop key selectively engages said stop guide to control the longitudinal movement of said piston rod.

3. The launcher as recited in claim 1, further including a main tube and a rotating cylinder drum disposed around said main tube, said cylinder drum containing a plurality of chambers each configured to hold a projectile.

4. The launcher as recited in claim 3, further including an index assembly that automatically rotates said cylinder drum over said main tube to position a chamber containing a projectile in alignment with said barrel.

5. The launcher, as recited in claim 4, wherein said index assembly includes an index tube and an index rod located above said cylinder drum, said index tube being coupled to said trigger and said valve cavity to receive pressurized air that forces said cylinder drum longitudinally over said main tube.

6. The launcher, as recited in claim 5, further including a plurality of interconnected spiral grooves formed on an external surface of said cylinder drum and a biased index lever configured to engage said spiral groove.

7. The launcher, as recited in claim 1, further including a viewing window formed on said valve plate that enables a user to see a projectile inside said chamber.

8. The launcher, as recited in claim 3, further including a slide body attached to said cylinder drum.

9. The launcher, as recited in claim 8, further including an index assembly that automatically rotates said cylinder drum over said main tube to position a chamber containing a projectile in alignment with said barrel.

10. The launcher, as recited in claim 9, wherein said index assembly includes an index tube and an index rod located above said cylinder drum, said index tube being coupled to said trigger and said valve cavity to receive pressurized air that forces said cylinder drum longitudinally over said main tube.

11. The launcher, as recited in claim 10, further including a plurality of interconnected spiral grooves formed on an external surface of said cylinder drum and a biased index lever configured to engage said spiral groove.

12. The launcher, as recited in claim 8, further including a viewing window formed on said valve plate that enables a user to see a projectile inside said chamber adjacent to said valve plate.

13. A launcher, comprising:

a. a barrel with an open end;

b. a ballast chamber with a closed end and a short bore section at the opposite end; said ballast chamber filled with pressurized air when said short bore section is closed;

c. a conduit extending between said short bore section on said ballast chamber;

d. a firing chamber with a conduit that connects to said ballast chamber;

e. a piston rod that extends between said ballast chamber, through said firing chamber;

f. a ballast piston attached to said piston rod and disposed inside said ballast chamber, said ballast piston has a surface area configured to close said short bore section in said ballast chamber when said ballast chamber is filled with pressurized air;

g. a firing piston attached to said piston rod and located inside said firing chamber, said firing piston has a surface area larger than said surface area on said ballast piston;

h. a velocity valve attached to said piston rod, said velocity valve configured to be set at different flow settings that limit the amount of longitudinal movement of said piston rod in said ballast chamber and thereby controlling the position of said ballast piston to partially or fully open said short bore section;

i. a pressurized air source, j. a trigger coupled to said pressurized air source and said firing chamber, said trigger configured to selectively control the flow of pressurized air from said pressurized air source to said firing chamber;

k. whereby when said velocity valve is adjusted to a desired setting and said trigger is activated, said pressurized air from said pressurized air source flows into said firing chamber and against said firing piston causing said piston rod to move longitudinally inside said ballast chamber the desired distance according to said setting and selectively open said short bore section and allow said pressurized air inside said ballast chamber to flow into said barrel and forcing a projectile located inside said barrel through said open end of said barrel.

14. The launcher, as recited in claim 1, wherein said velocity valve includes a velocity housing and a stop ring and a stop guide located inside said velocity housing, said stop guide and a stop key affixed to said piston rod, said stop key selectively engages said stop guide to control the longitudinally movement of said piston rod.

15. The launcher as recited in claim 1, further including a rotating cylinder drum containing a plurality of chambers each configured to hold a projectile.

16. The launcher as recited in claim 15, further including an index assembly that automatically rotates said cylinder drum chamber containing a projectile in alignment with said barrel.

17. The launcher, as recited in claim 16, wherein said index assembly includes an index tube and an index rod located above said cylinder drum, said index tube being coupled to said trigger.

18. The launcher, as recited in claim 5, further including a plurality of interconnected spiral grooves formed on an external surface of said cylinder drum and a biased index lever configured to engage said spiral groove.

* * * * *